US008080721B2

(12) United States Patent
Shimoda

(10) Patent No.: US 8,080,721 B2
(45) Date of Patent: Dec. 20, 2011

(54) HAMMER FOR ELECTRONIC KEYBOARD INSTRUMENT

(75) Inventor: Yoshiaki Shimoda, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 23 days.

(21) Appl. No.: 12/836,491

(22) Filed: Jul. 14, 2010

(65) Prior Publication Data

US 2011/0011249 A1 Jan. 20, 2011

(30) Foreign Application Priority Data

Jul. 17, 2009 (JP) ..... 2009-169036

(51) Int. Cl.
*G10D 13/02* (2006.01)

(52) U.S. Cl. ..... 84/423 R

(58) Field of Classification Search ..... 84/173, 84/174, 236, 423 R, 452 R, 452 P, 424, 425
See application file for complete search history.

(56) References Cited

U.S. PATENT DOCUMENTS 7,767,891 B2 * 8/2010 Yamaguchi ..... 84/423 R

FOREIGN PATENT DOCUMENTS

JP 2006-3495 1/2006

* cited by examiner

*Primary Examiner* — Kimberly Lockett

(74) *Attorney, Agent, or Firm* — Christie, Parker & Hale LLP

(57) ABSTRACT

A hammer for an electronic keyboard instrument, constructed to ensure secure mounting of a weight to a hammer body and enable both assembly and disassembly of the hammer to be easily performed. The hammer includes a hammer body having a weight mounting portion that is open on one side in a left-right direction and a weight removably mounted to the hammer body via a mounting portion. The weight mounting portion has a housing portion that has an opening having a shape complementary to the mounting portion, and houses the mounting portion in a manner slidable between a fit-in position and a fixed position, latching portions for latching the mounting portion incapable of falling off from the opening when in the fixed position, and holding portions for holding the mounting portion non-slidable to the fit-in position.

4 Claims, 5 Drawing Sheets

HAMMER FOR ELECTRONIC KEYBOARD INSTRUMENT

CROSS-REFERENCE TO RELATED APPLICATION

This application claims priority of Japanese Patent Application Number 169036/2009, filed on Jul. 17, 2009.

BACKGROUND OF THE INVENTION

1. Field of the Invention

The present invention relates to a hammer for an electronic keyboard instrument, which is provided for each key in an electronic keyboard instrument, such as an electronic piano, so as to impart touch weight to each key during key depression.

2. Description of the Related Art

Conventionally, there has been known a hammer for an electronic piano, disclosed in Japanese Laid-Open Patent Publication No. 2006-3495 ([0029], FIGS. 1 and 3 to 5). The hammers are pivotally mounted in association with respective keys on a keyboard chassis supporting a keyboard, and each of the hammers pivotally moves in accordance with depression of an associated one of the keys to thereby impart a predetermined touch weight to the key. As a consequence, the electronic piano can provide a touch feeling closely analogous to that of an acoustic piano.

The hammer is disposed below the associated key, and comprises a metal hammer body extending along the length of the key, and a hammer holder made of a synthetic resin, which is mounted to a side surface of the hammer body and is pivotally supported by the keyboard chassis. The hammer body is formed by a metal plate having a predetermined shape. Specifically, the hammer body has a front end thereof formed in a rearwardly opening C shape in side view, and a rear end thereof formed in a relatively large triangular shape in side view.

On the other hand, the hammer holder is a molded article having a predetermined shape, and is mounted to the front end of the hammer body. Specifically, the hammer holder, when in a state mounted to the hammer body, has a bearing portion formed inside a C-shaped portion of the front end thereof, and a mounting portion to be mounted to the hammer body at respective locations upward and downward of the bearing portion. The mounting portion has a C shape in cross section, which is formed by a body portion formed in a shape corresponding to the shape, in side view, of a portion of the hammer body to which the mounting portion is to be mounted, and collar portions formed along the respective upper and lower edges of the body portion, with an end of each collar portion remote from the body portion being formed with a plurality of clipping pieces for cooperating with the body portion to clip the hammer body in the direction of thickness of the hammer body. Further, the body portion is formed with an engaging portion protruding inside the mounting portion. This engaging portion engages with an engaging hole formed at a predetermined location in the hammer body, whereby displacement and wobbling of the hammer holder with respect to the hammer body are suppressed.

The hammer holder constructed as above is mounted to the hammer body as follows: The body portion of the hammer holder is aligned to the portion of the hammer body to which the body portion is to be mounted, and then pressed toward the hammer body. In this case, a space between the clipping pieces of the hammer holder is opened up in the lateral direction (vertical direction) of the hammer body, and the clipping pieces pass over the respective upper and lower edges of the hammer body whereby they reach the remote side of the hammer body from the body portion, with the hammer body therebetween. Thus, the hammer holder is mounted to the hammer body in a state sandwiching the hammer body in the direction of the thickness of the same between the body portion and the clipping pieces.

As described above, the hammer holder is mounted to the hammer body during assembly of the hammer by opening up the space between the clipping pieces of the hammer holder. Therefore, when the hammer holder is formed of a relatively hard synthetic resin material, a relatively large urging force is required. Further, in the case of disposing of an electronic piano provided with the hammers constructed as above, work for disassembling each of the hammers into the metal hammer body and the hammer holder formed of the synthetic resin material is very complicated and troublesome when a sequence reverse to the above-described sequence is employed. The hammer described above suffers from the problem that work for assembly and disassembly of the hammer comprising the hammer body and the hammer holder is thus complicated and troublesome. Further, there is a fear that a gap is formed between the hammer body and the inner surface of the mounting portion of the hammer holder e.g. due to inevitable size error in manufacturing the hammer body and the hammer holder, causing wobbling and resultant noises during pivotal motion of the hammer performed in accordance with key depression.

SUMMARY OF THE INVENTION

It is an object of the present invention to provide a hammer for an electronic keyboard instrument, in which the hammer including a hammer body and a weight has a construction that ensures secure mounting of the weight to the hammer body and makes it possible to facilitate not only assembly of the hammer from the two parts, but also disassembly of the same.

To attain the above object, the present invention provides a hammer for an electronic keyboard instrument, which pivotally moves in accordance with depression of a key to thereby impart touch weight to the key, comprising a hammer body that is formed by a resin molded article and having a weight mounting portion extending in a front-rear direction, and a weight that is formed of a material larger in specific gravity than the hammer body and has a mounting portion to be mounted to the weight mounting portion, the weight being removably mounted to the hammer body via the mounting portion, wherein the weight mounting portion of the hammer body comprises a housing portion that has an opening open on one side in a left-right direction and having a shape complementary to the mounting portion of the weight, and houses the mounting portion in a manner slidable between a fit-in position in which the mounting portion is fitted via the opening and a fixed position shifted from the fit-in position in a direction different from the left-right direction, a latching portion that is formed on a rim of the opening and latches the mounting portion in a state undetachable from the opening when the mounting portion is positioned in the fixed position, and a holding portion that holds the mounting portion in a state incapable of sliding to the fit-in position when the mounting portion is positioned in the fixed position.

With this arrangement, the hammer body formed by a resin molded article has the weight mounting portion extending in the front-rear direction, while the weight formed of a material larger in specific gravity than the hammer body has the mounting portion to be mounted to the weight mounting portion of the hammer body. Further, the weight mounting portion of the hammer body includes the housing portion that has the opening open on one side in the left-right direction and has a shape complementary to the mounting portion of the weight. The housing portion is configured to house the mounting portion of the weight in a manner slidable between the fit-in position in which the mounting portion is fitted via the opening and the fixed position shifted from the fit-in position in a direction different from the left-right direction.

When assembling the hammer, first, the mounting portion of the weight is fitted in the housing portion via the opening of the housing portion of the hammer body. Then, the mounting portion in the fit-in position is slid to the fixed position. As a consequence, the mounting portion in the fixed position is latched by the latching portion formed on the rim of the opening of the hammer body and held in a state in which it is prevented from falling off from the opening. Further, the mounting portion is held by the holding portion in a state incapable of sliding to the fit-in position. As described above, it is possible to easily assemble the hammer by simple work, and mount the weight securely to the hammer body. On the other hand, when disassembling the hammer into the hammer body and the weight, the mounting portion in the fixed position is slid to the fit-in position while releasing hold of the mounting portion by the holding portion or after releasing the hold. Then, the mounting portion of the weight is dismounted from the weight mounting portion of the hammer body via the opening. Thus, the disassembly of the hammer can be performed with ease.

Preferably, the holding portion comprises a hook engaged with the mounting portion to inhibit the mounting portion from sliding to the fit-in position when the mounting portion is positioned in the fixed position, but allow the mounting portion to slide to the fit-in position when an external force not smaller than a predetermined magnitude acts on the mounting portion in a direction toward the fit-in position.

With this arrangement, the holding portion has the hook engaged with the mounting portion of the weight, and the hook inhibits the mounting portion positioned in the fixed position from sliding to the fit-in position, so that it is possible to securely hold the mounting portion in the fixed position. Further, when an external force not smaller than the predetermined magnitude acts on the mounting portion positioned in the fixed position in the direction toward the fit-in position, the hook allows the mounting portion to slide to the fit-in position. Therefore, when disassembling the hammer, it is possible to easily dismount the weight from the hammer body simply by sliding the mounting portion of the weight to the fit-in position while causing the external force to act on the mounting portion.

More preferably, the holding portion further comprises an engaging protrusion protruding inward from an inner surface of the housing portion, for engagement with the mounting portion.

With this arrangement, not only the above-mentioned hook but also the engaging protrusion protruding inward from the inner surface of the housing portion engages, as the holding portion, with the mounting portion of the weight. This makes it possible to hold the mounting portion more securely in the fixed position.

Preferably, the inner surface of the housing portion is formed with a protrusion that is brought into pressure contact with the mounting portion to thereby suppress wobbling of the mounting portion.

With this arrangement, the protrusion formed on the inner surface of the housing portion of the hammer body is brought into pressure contact with the mounting portion of the weight. For example, in a case where the hammer is constructed such that the surface of the mounting portion and the inner surface of the housing portion are held in surface contact with each other, when a gap is formed between the two surfaces e.g. due to inevitable size error in manufacturing, the weight can wobble relative to the hammer body during pivotal motion of the hammer. Therefore, by employing the above arrangement of the present invention, it is possible to effectively suppress wobbling of the weight against the hammer body.

The above and other objects, features, and advantages of the present invention will become more apparent from the following detailed description taken in conjunction with the accompanying drawings.

BRIEF DESCRIPTION OF THE DRAWINGS

FIGS. 1A and 1B are side views of a keyboard device for an electronic piano, including a hammer according to a first embodiment of the present invention, in which;

FIG. 1A shows a key-released state of a white key; and

FIG. 1B shows a key-depressed state of the white key;

DETAILED DESCRIPTION OF PREFERRED EMBODIMENTS

Figure 1A:
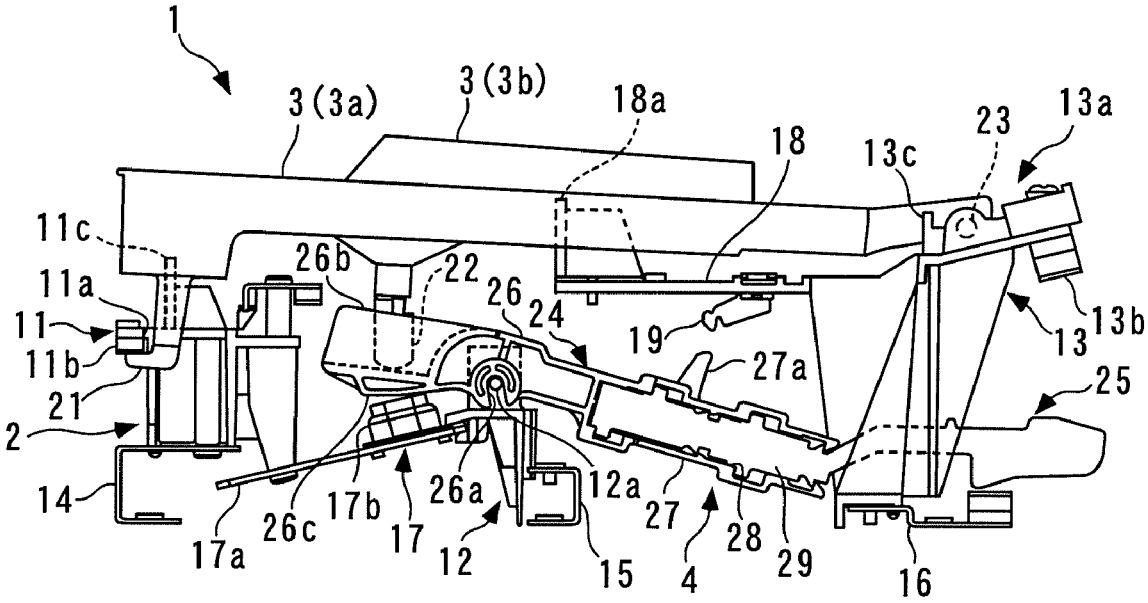
Figure 1B:
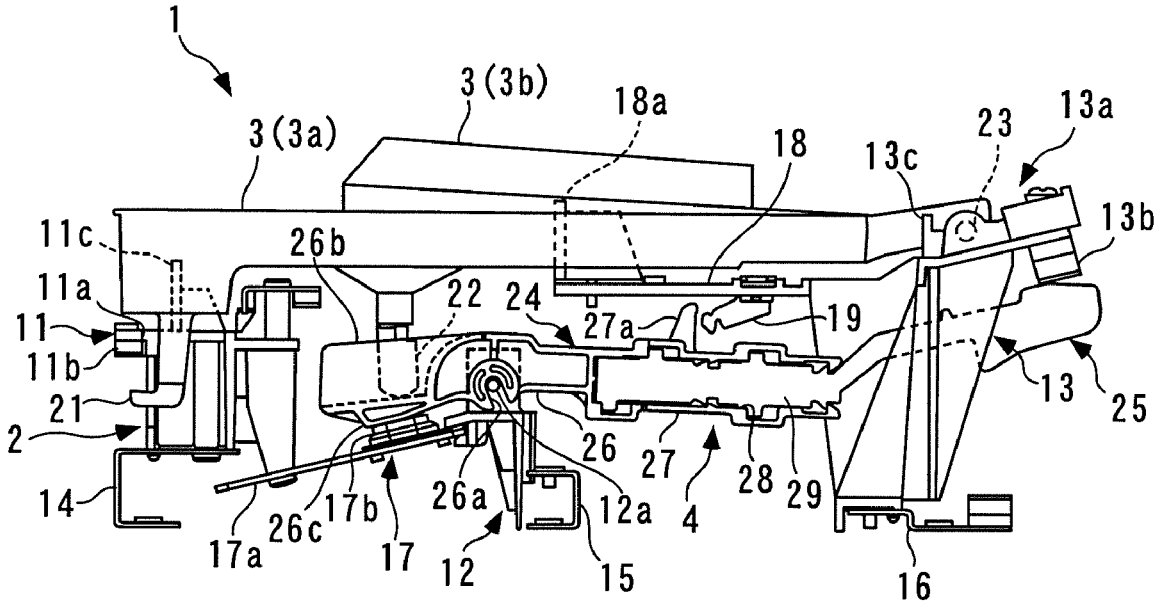

The present invention will now be described in detail with reference to the drawings showing a preferred embodiment thereof. FIGS. 1A and 1B show a keyboard device for an electronic piano, including a hammer according to a first embodiment of the present invention. As shown in FIGS. 1A and 1B, the keyboard device 1 includes a keyboard chassis 2, a plurality of (e.g. eighty-eight) keys 3 pivotally mounted on the keyboard chassis 2 and including white keys 3*a* and black keys 3*b*, and a plurality of hammers 4 (only one of which is shown) each provided for an associated one of the keys 3 and pivotally mounted on the keyboard chassis 2.

In the following, a description will be given of the outline of the arrangement and operation of the keyboard device 1 first, and then the construction of the hammer 4 and a method of assembling the same will be described, with reference to FIGS. 1A and 1B.

The keyboard chassis 2 is a resin molded article in a predetermined shape which is formed by injection molding of a predetermined resin material (e.g. ABS resin). The keyboard chassis 2 has a front part (left part as viewed in FIGS. 1A and 1B) 11 thereof, a central part 12 thereof, and a rear part (right part as viewed in FIGS. 1A and 1B) 13 thereof integrally formed in a state connected to each other by ribs (not shown), and is rigidly secured on a keybed of an electronic piano, not shown, via a front mounting rail 14, a central mounting rail 15, and a rear mounting rail 16 each extending in a left-right direction (depth direction as viewed in FIGS. 1A and 1B). It should be noted that in the following description, the front part 11, the central part 12, and the rear part 13 of the keyboard chassis 2 will be referred to as "the chassis front part 11", "the chassis central part 12", and "the chassis rear part 13", respectively.

The chassis front part 11 has a plurality of pairs of engaging holes 11*a*, each pair of which comprises two engaging holes 11*a* left and right (only one of which is shown in FIGS. 1A and 1B) vertically extending through the chassis front part 11 and is provided for an associated white key 3*a*. Through the left and right engaging holes 11*a* are inserted respective left and right upper limit position-restricting portions 21, referred to hereinafter, of the associated white key 3*a*. Further, the chassis front part 11 has a key stopper 11*b* formed e.g. of felt and attached to the bottom of a front-portion of a rim of each of the engaging hole 11*a*. The upper limit position-restricting portions 21 of the white key 3*a* are brought into abutment with the key stopper 11*b* from below when in a key-released state, whereby the upper limit position of the white key 3*a* is restricted. Furthermore, the chassis front part 11 has a plurality of front guides 11*c* (only one of which is shown in FIGS. 1A and 1B) erected therefrom in association with the respective white keys 3*a* so as to prevent lateral swing of the white keys. Each of the front guides 11*c* has approximately the same width as the lateral inner width (width in the left-right direction) of the white key 3*a*, and is inserted in the associated white key 3*a* from below.

The chassis central part 12 has a support shaft 12*a* extending in the left-right direction, and the hammers 4 are pivotally supported on the support shaft 12*a*. Further, key switches 17 extending toward the chassis front part 11 are mounted on the chassis central part 12, for detecting key depression information on the respective associated keys 3. Each of the key switches 17 comprises a printed circuit board 17*a* and a switch body 17*b* which is formed by a rubber switch and attached to the printed circuit board 17*a*, for an associated one of the keys 3. The key switch 17 is mounted to the keyboard chassis 2 with the rear end of the printed circuit board 17*a* inserted in the chassis central part 12 and the front end of the same screwed to the chassis front part 11.

The chassis rear part 13 has a key support section 13*a* that supports a pivot shaft 23, referred to hereinafter, provided on the rear end of each key 3, to thereby support the key 3 in a manner pivotally movable about the axis of the pivot shaft 23. Further, a hammer stopper 13*b* formed e.g. of felt is attached to the rear end of the lower surface of the key support section 13*a*. Furthermore, the chassis rear part 13 has two rear guides 13*c* left and right (only one of which is shown in FIGS. 1A and 1B) located forward of the key support section 13*a* and erected at respective locations leftward and rightward of the rear end of each key 3 so as to prevent lateral swing of the key 3.

Between the chassis rear part 13 and the chassis central part 12, there is disposed a flat plate 18 extending substantially horizontally between the keys 3 and the hammers 4. This flat plate 18 has a plurality of front guides 18*a* (only one of which is shown in FIGS. 1A and 1B) erected from the front end thereof in association with the respective black keys 3*b* so as to prevent lateral swing of the black keys 3*b*. Similarly to the front guide 11*c* for each white key 3*a*, each of the front guides 18*a* has approximately the same width as the lateral inner width of the black key 3*b*, and is inserted in the associated black key 3*b* from below.

It should be noted that a plurality of let-off members 19 (only one of which is shown in FIGS. 1A and 1B) each formed of an elastic material are mounted to the flat plate 18 in association with the respective hammers 4 in a manner protruding obliquely downward and forward from the lower surface of the same. When a hammer 4 that pivotally moves along with key depression comes into temporary engagement with an associated one of the let-off members 19 during the pivotal motion, let-off feeling is added to the touch feeling of the depressed key 3.

Each key 3 is formed e.g. by injection molding of a predetermined resin material (e.g. AS resin) such that it has a hollow shape extending in the front-rear direction and opening downward. The white key 3*a* has a front end thereof formed with the pair of left and right upper limit position-restricting portions 21 and 21 (only one of which is shown in FIGS. 1A and 1B). The left and right upper limit position-restricting portions 21 and 21 extend downward from the respective left and right side walls of the white key 3*a* and each have a lower end thereof bent forward. The left and right upper limit position-restricting portions 21 and 21 are engaged with the respective left and right engaging holes 11*a* and 11*a* of the chassis front part 11, in respective states extending therethrough. Further, the white key 3*a* has an actuator portion 22 formed at a predetermined location thereof rearward of the upper limit position-restricting portions 21 in a manner protruding downward, and the actuator portion 22 is engaged with an engaging recess 26*b*, referred to hereinafter, of the hammer 4 in a state received therein. Furthermore, the key 3 has the rear end thereof provided with the pivot shaft 23 extending in the left-right direction. It should be noted that in each black key 3*b*, portions corresponding to the upper limit position-restricting portions 21 and the actuator portion 22 of the white key 3*a* are integrally formed with respective lower portions of the front end thereof.

Each hammer 4 comprises a hammer body 24 and a weight 25 removably attached to the hammer body 24. The hammer body 24 is a resin molded article in a predetermined shape formed e.g. by injection molding of a predetermined resin material (e.g. POM (polyacetal resin)). The hammer body 24 extends in the front-rear direction and has a shaft bearing portion 26*a* formed at a predetermined location in a front half (left half as viewed in FIGS. 1A and 1B) 26 thereof and having an inverted U shape in side view, and the shaft bearing portion 26*a* is pivotally engaged with the support shaft 12*a* of the chassis central part 12. The engaging recess 26*b* for engagement with the actuator portion 22 of the key 3 is formed in the front half 26 of the hammer body 24 at a location forward of the shaft bearing portion 26*a*. The engaging recess 26*b* is open upward and forward, and the lower part of the actuator portion 22 of the key 3 is received in the engaging recess 26*b* in a state where the lower end of the actuator portion 22 is held in contact with the bottom surface of the engaging recess 26*b*. Further, formed under the engaging recess 26*b* in the front half 26 of the hammer body 24 is a switch pressing portion 26*c* for pressing the switch body 17*b* of the key switch 17.

A weight mounting portion 27 forming the rear half of the hammer body 24 includes a housing portion 35 having an opening 28 open rightward (frontward as viewed in FIGS. 1A and 1B), and the weight 25 is removably mounted to the hammer body 24 via the opening 28. Further, an engaging protrusion 27*a* for engagement with the let-off member 19 during key depression is formed on the weight mounting portion 27 of the hammer body 24 at a predetermined location in a manner protruding upward from the weight mounting portion 27.

On the other hand, the weight 25 is formed of a material (steel or the like material) having a larger specific gravity than that of the hammer body 24. The weight 25 is formed into a predetermined shape by pressing a metal plate having a smaller thickness than the thickness (thickness in the depth direction as viewed in FIGS. 1A and 1B) of the hammer body 24. The weight 25 extends in the front-rear direction and has a front half thereof formed as a mounting portion 29 mounted in the weight mounting portion 27 of the hammer body 24. The weight 25 extends rearward from the mounting portion 29 to a location near the rear end of the chassis rear part 13, and has a rear end thereof formed to have a relatively large vertical width (width in an up-down direction).

In the keyboard device 1 constructed as above, when a key 3 (the white key 3*a* in FIG. 1A) is depressed in the key-released state shown in FIG. 1A, the key 3 pivotally moves counterclockwise, as viewed in FIG. 1A, about the axis of the pivot shaft 23 of the rear end of the key 3, as shown in FIG. 1B. In accordance with this pivotal motion of the key 3, the actuator portion 22 of the key 3 presses the engaging recess 26*b* of the hammer 4 downward. As a consequence, the hammer 4 presses the switch body 17*b* of the key switch 17 from above by the switch pressing portion 26*c* while pivotally moving counterclockwise about the support shaft 12*a* of the chassis central part 12. In this case, the rear end of the hammer 4 (i.e. the rear end of the weight 25) is brought into abutment with the hammer stopper 13*b* of the chassis rear part 13 from below, whereby further pivotal motion of the hammer 4 is prevented. The key depressing operation described above makes it possible to impart a predetermined touch weight corresponding to the weight and torque of the hammer 4 to the key 3 and detect key depression information on the key 3 via the key switch 17 at the same time.

On the other hand, when the depressed key 3 is released, the hammer 4 pivotally moves clockwise, as viewed in FIG. 1B. In accordance with this pivotal motion of the hammer 4, the key 3 is pushed upward via the actuator portion 22 and pivotally moves clockwise. As a consequence, each of the key 3 and the hammer 4 returns to its key-released position as shown in FIG. 1A. In this case, the upper limit position-restricting portions 21 of the front end of the key 3 are brought into abutment with the key stopper 11*b* of the chassis front part 11 from below, whereby further pivotal motion of the key 3 is prevented.

Next, the construction of the hammer 4 and the method of assembling the same will be described with reference to FIGS. 2A to 4C. More specifically, a description will be given of the mounting structure of the weight 25 in the hammer body 24 and the method of mounting the weight 25 to the hammer body 24.

Figure 2A:
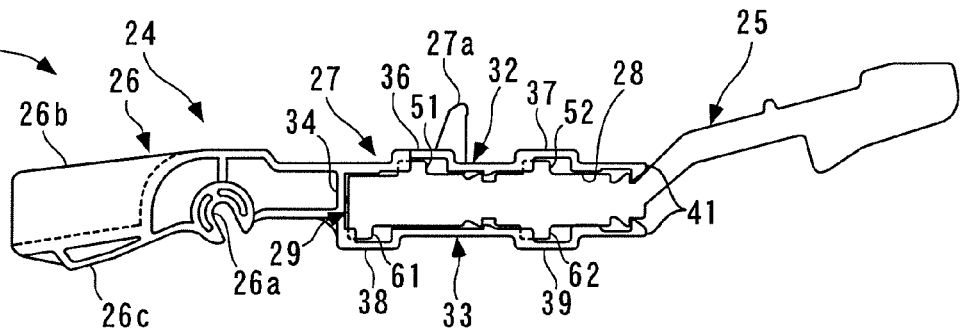
FIG. 2A is a side view of the hammer.
Figure 2B:
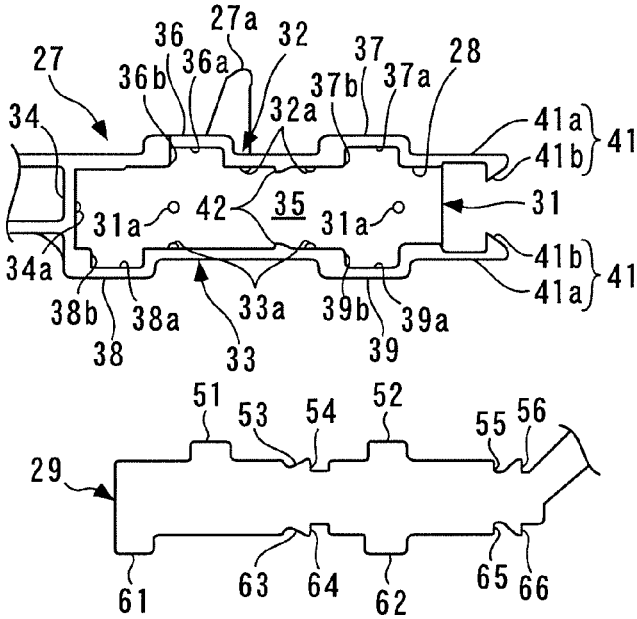
FIG. 2B is a side view showing a weight mounting portion of a hammer body and a mounting portion of a weight in a state separated from each other, on an enlarged scale.
Figure 3:
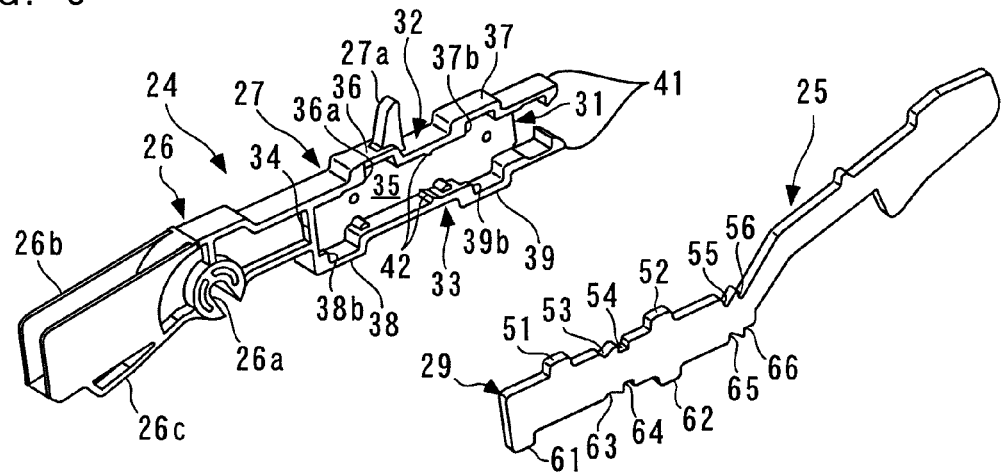
FIG. 3 is an exploded perspective view of the hammer in a state where the weight is dismounted from the hammer body.

As shown in FIGS. 2A, 2B, and 3, the weight mounting portion 27 to which the weight 25 is mounted comprises a left side wall 31 having a predetermined shape and extending in the front-rear direction, an upper wall 32 and a lower wall 33 extending along the respective upper and lower edges of the left side wall 31 and protruding rightward from the left side wall 31, in facing relation to each other, and a front wall 34 continuous with the left side wall 31, the upper wall 32, and the lower wall 33. The weight 25 is mounted to the hammer body 24, with the mounting portion 29 of the weight 25 housed in the housing portion 35 defined by the left side wall 31, the upper wall 32, the lower wall 33, and the front wall 34 and extending in the front-rear direction.

Each of the upper wall 32 and the lower wall 33 has a substantially uniform predetermined thickness, and has two protrusions front and rear having a relatively large width in the front-rear direction. Specifically, the upper wall 32 has a front protrusion 36 and a rear protrusion 37 formed in a manner spaced from each other in the front-rear direction and protruding upward, while the lower wall 33 has a front protrusion 38 and a rear protrusion 39 each protruding downward. The front protrusion 36 of the upper wall 32 is formed at a location spaced rearward from the front wall 34 of the weight mounting portion 27 by a predetermined distance, whereas the front protrusion 38 of the lower wall 33 is formed in a manner continuous with the front wall 34. In short, the front protrusions 36 and 38 are formed at the locations displaced from each other in the front-rear direction. On the other hand, the rear protrusions 37 and 39 are formed at the locations vertically symmetrical to each other.

The housing portion 35 of the weight mounting portion 27 has inwardly-opening recesses formed by the front protrusions 36 and 38 and the rear protrusions 37 and 39 of the upper wall 32 and the lower wall 33, respectively. Specifically, as shown in FIG. 2B, the housing portion 35 has a front recess 36*a* and a rear recess 37*a* corresponding to the front protrusion 36 and the rear protrusion 37 of the upper wall 32, at respective upper locations therein, and a front recess 38*a* and a rear recess 39*a* corresponding to the front protrusion 38 and the rear protrusion 39 of the lower wall 33, at respective lower locations therein.

Further, each of the front protrusions 36 and 38 and the rear protrusions 37 and 39 of the upper wall 32 and the lower wall 33 has a front end thereof formed with an engaging portion for preventing fall-off of the weight 25. Specifically, as shown in FIGS. 2B and 3, the front end of the front protrusion 36 and that of the rear protrusion 37 of the upper wall 32 have a latching portion 36*b* and a latching portion 37*b*, respectively, formed on an opening-side end of the housing portion 35 in a manner slightly protruding inside the housing portion 35, while the front end of the front protrusion 38 and that of the rear protrusion 39 of the lower wall 33 have respective latching portions 38*b* and 39*b* similar to the latching portions 36*b* and 37*b*.

The upper wall 32 and the lower wall 33 have rear ends thereof formed with a pair of respective hooks 41 and 41 upper and lower for preventing the weight 25 mounted to the hammer body 24 from sliding rearward. Each of the hooks 41 comprises a hook piece 41*a* extending further rearward than the rear end of the left side wall 31 by a predetermined length and a hook-shaped hook body 41*b* formed on the rear end of the hook piece 41*a* in a manner protruding inward. It should be noted that the hook piece 41*a* of each hook 41 is formed to be thinner than the upper wall 32 and the lower wall 33 located in front of the hooks 41, and is slightly vertically flexible.

The housing portion 35 of the weight mounting portion 27 has inner surfaces thereof formed with projections for suppressing wobbling of the mounting portion 29 of the weight 25 by pressure contact with the same when the hammer body 24 is mounted on the weight 25. Specifically, as shown in FIG. 2B, on an inner surface of the left side wall 31, there are formed two projections 31*a* and 31*a* front and rear spaced from each other in the front-right direction and slightly protruding inward. Further, on an inner surface of the upper wall 32 between the front protrusion 36 and the rear protrusion 37, there are formed two projections 32*a* and 32*a* front and rear spaced from each other in the front-rear direction, in a manner extending in the left-right direction and slightly protruding inward. Similarly, on an inner surface of the lower wall 33 between the front protrusion 38 and the rear protrusion 39, there are formed two projections 33*a* and 33*a* front and rear. Further, at the vertical center of the inner surface of the front wall 34, there is formed a projection 34*a* similar to the projections 32*a* and 33*a* of the upper and lower walls 32 and 33.

On the inner surfaces of the respective upper and lower walls 32 and 33, there are formed a pair of respective engaging protrusions 42 and 42 upper and lower, which cooperate with the pair of hooks 41 and 41 to prevent the weight 25 mounted to the hammer body 24 from sliding rearward. The two engaging protrusions 42 and 42 are formed in vertically symmetrical relation to each other. The upper engaging protrusion 42 is located approximately at a center between the front and rear projections 32*a* and 32*a* of the upper wall 32, while the lower engaging protrusion 42 is located between the front and rear projections 33*a* and 33*a* of the lower wall 33 and formed in a manner vertically symmetrical to the upper engaging protrusion 42. Further, each of the engaging protrusions 42 is formed in a wedge shape in side view by a front sloping surface with a relatively large inclination angle with reference to the inner surface of the upper wall 32 or the lower wall 33 and a rear sloping surface with a relatively small inclination angle with reference to the same.

In the weight mounting portion 27 of the hammer body 24 constructed as above, the rim of the opening 28 of the housing portion 35 is defined by respective right-side ends of the upper wall 32, the lower wall 33, and the front wall 34 as viewed in FIG. 3.

The mounting portion 29 of the weight 25 has a shape complementary to the opening 28 of the housing portion 35 of the weight mounting portion 27 of the hammer body 24. Specifically, as shown in FIG. 2B, the mounting portion 29 has an upper portion thereof formed with a front protrusion 51 and a rear protrusion 52 corresponding to the respective front and rear recesses 36*a* and 37*a* of the upper wall 32 of the weight mounting portion 27. Further, the upper portion of the mounting portion 29 is formed with an engaging recess 53 corresponding to the engaging protrusion 42 of the inner surface of the upper wall 32 and having an upwardly opening V shape in side view, and an upwardly opening C-shaped latching recess 54 located immediately rearward of the engaging recess 53. Furthermore, the rear end of the upper portion of the mounting portion 29 is formed with an engaging recess 55 corresponding to the hook body 41*b* of the rear end of the upper wall 32 and having an upwardly opening V shape in side view, and a hook latching portion 56 located immediately rearward of the engaging recess 55.

On the other hand, the mounting portion 29 has a lower portion thereof formed with a front protrusion 61 and a rear protrusion 62 corresponding to the respective front and rear recesses 38*a* and 39*a* of the lower wall 33 of the weight mounting portion 27, and the latter 62 of the rear protrusions 61 and 62 is formed in a manner vertically symmetrical to the rear protrusion 52. Further, the lower portion of the mounting portion 29 is formed with an engaging recess 63 and a latching recess 64 corresponding to the engaging protrusion 42 of the inner surface of the lower wall 33 and vertically symmetrical to the engaging recess 53 and the latching recess 54 respectively. Furthermore, the rear end of the lower portion of the mounting portion 29 is formed with an engaging recess 65 and a hook latching portion 66 corresponding to the hook body 41*b* of the lower wall 33 and vertically symmetrical to the engaging recess 55 and the hook latching portion 56, respectively.

Figure 4A:
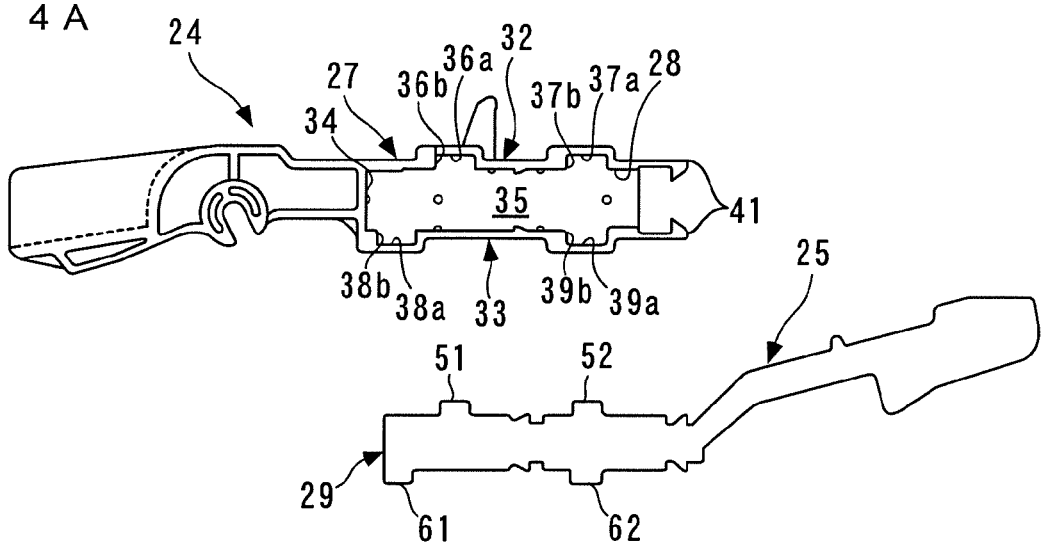
FIGS. 4A to 4C are views useful in explaining a sequence for assembling the hammer.
Figure 4B:
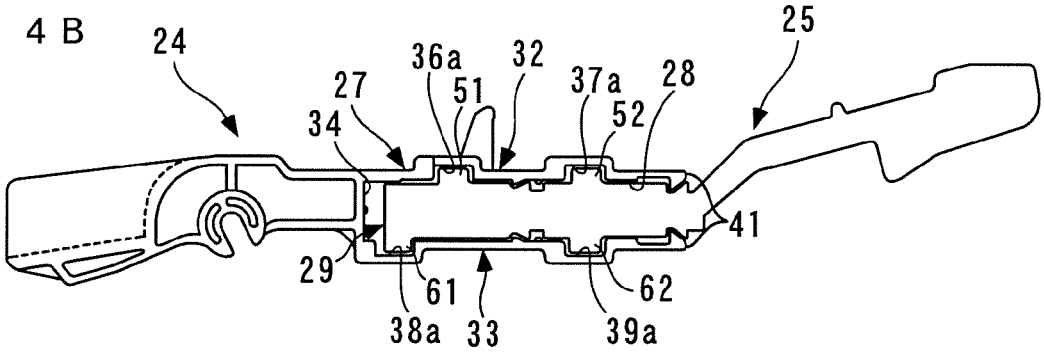
Figure 4C:
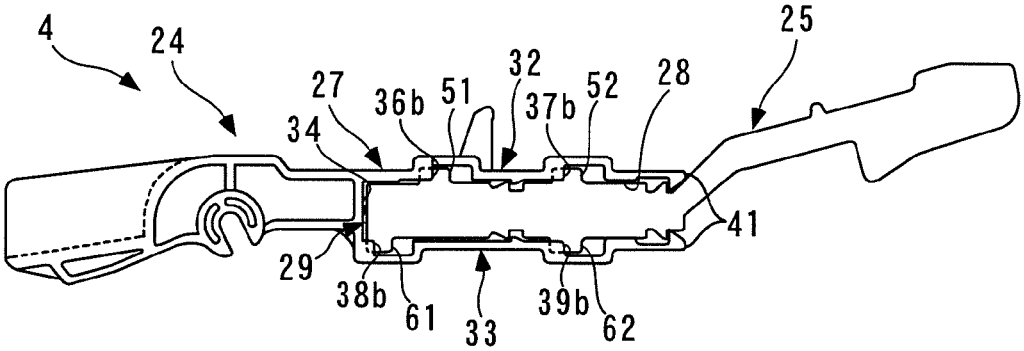

Next, the method of mounting the weight 25 to the hammer body 24 will be described with reference to FIGS. 4A to 4C. First, the hammer body 24 and the weight 25 constructed as above are prepared, as shown in FIG. 4A, and the mounting portion 29 of the weight 25 is fitted in the housing portion 35 (fit-in position) of the weight mounting portion 27 of the hammer body 24 via the opening 28 as shown in FIG. 4B. In this case, the front end of the mounting portion 29 is held with a gap having a predetermined distance from the front wall 34 of the hammer body 24. Further, in this case, the projections 32*a* and 33*a* of the respective upper and lower walls 32 and 33 of the weight mounting portion 27 are held in pressure contact with the respective upper and lower end surfaces of the mounting portion 29 in a state slightly crushed by these. Thus, the mounting portion 29 is held immovable in the vertical direction thereof.

It should be noted that when fitting the mounting portion 29 in the housing portion 35, the mounting portion 29 can be properly fitted in the housing portion 35 without confusing between the front and back sides of the weight 25. This is because the mounting portion 29 has the front protrusions 51 and 61 formed in vertically asymmetrical relation, though the rear protrusions 52 and 62 are vertically symmetrical, so that only when the front and back sides of the weight 25 face properly, the mounting portion 29 is allowed to be fitted in the housing portion 35 via the opening 28.

Then, one of the hammer body 24 and the weight 25 is fixed, and then the other of the two is slid to thereby bring the front wall 34 of the weight mounting portion 27 and the front end of the mounting portion 29 close to each other. For example, in FIG. 4B, if the hammer body 24 is fixed, the weight 25 is slid forward (leftward as viewed in FIG. 4B). In this case, the rear end of the mounting portion 29 pushes the upper and lower hooks 41 and 41 of the weight mounting portion 27 to open up the space between the two hooks 41 and 41, whereby the hook pieces 41*a* and 41*a* are slightly bent in respective opposite directions, and the hook bodies 41*b* and 41*b* pass over the rear walls of the respective upper and lower engaging recesses 55 and 65 of the mounting portion 29 to be engaged with the respective upper and lower hook engaging portions 56 and 66. Thus, the mounting portion 29 of the weight 25 is held in a fixed position shifted forward of the fit-in position as shown in FIG. 4C, and the assembly of the hammer 4 is completed.

In the hammer 4, each of the upper and lower front protrusions 51 and 61 and the upper and lower rear protrusions 52 and 62 of the mounting portion 29 of the weight 25 has its front end sandwiched between the left side wall 31 of the weight mounting portion 27 of the hammer body 24 and an associated one of the latching portions 36*b* and 38*b* of the respective upper and lower front recesses 36*a* and 38*a* and the latching portions 37*b* and 39*b* of the respective upper and lower rear recesses 37*a* and 39*a*. As a consequence, the mounting portion 29 is prevented from falling off from the opening 28 by the four latching portions 36*b*, 37*b*, 38*b*, and 39*b* of the weight mounting portion 27 latching the four portions of the front protrusions 51 and 61 and the rear protrusions 52 and 62. Further, in this case, the projections 31*a* of the left side wall 31 of the weight mounting portion 27 are held in pressure contact with the left side surface of the mounting portion 29 in a state slightly crushed by the same. Thus, the mounting portion 29 is held immovable in the direction of thickness thereof.

Further, in the hammer 4, as described hereinbefore, the upper and lower hook bodies 41*b* and 41*b* of the weight mounting portion 27 are engaged with the respective hook engaging portions 56 and 66 of the mounting portion 29, and the upper and lower engaging protrusions 42 and 42 of the weight mounting portion 27 are engaged with the respective upper and lower latching recesses 54 and 64 of the mounting portion 29. As a consequence, the mounting portion 29 positioned in the fixed position is brought into a state where sliding to the fit-in position is inhibited. Further, in this case, the projection 34*a* of the front wall 34 of the weight mounting portion 27 is brought into a state slightly crushed by the front end surface of the mounting portion 29 to be held in pressure contact with the same. Thus, the mounting portion 29 is held immovable in the longitudinal direction thereof (left-right direction as viewed in FIGS. 4A to 4C).

According to the present embodiment, since the mounting portion 29 of the weight 25 is held in the weight mounting portion 27 of the hammer body 24 in a manner immovable in any of the vertical direction, the direction of thickness, and the direction of length as described above, it is possible to obtain the hammer 4 with the weight 25 securely mounted to the hammer body 24 such that it does not wobble. Further, the hammer 4 can be easily assembled by relatively simple work of fitting the mounting portion 29 of the weight 25 in the housing portion 35 of the weight mounting portion 27 of the hammer body 24 via the opening 28 of the housing portion 35 and then sliding the mounting portion 29.

It should be noted that when it is required to disassemble each of the hammers 4 into the resin hammer body 24 and the metal weight 25 in the case of disposing of an electronic piano provided with the hammers 4, it is possible to easily dismount the weight 25 from the hammer body 24 by a sequence reverse to the above-described sequence of assembly of the hammer 4. Specifically, when an external force of a predetermined magnitude is caused to act on the mounting portion 29 to slide the same toward the fit-in position, engagement of the hooks 41 and 41 and the engaging protrusions 42 and 42 of the weight mounting portion 27 with the mounting portion 29 is released, whereby the mounting portion 29 slides to the fit-in position. Then, the mounting portion 29 is dismounted from the housing portion 35 of the weight mounting portion 27 via the opening 28 thereof. Thus, the hammer 4 can be disassembled with ease.

Next, the construction of a hammer 71 according to a second embodiment of the present invention and a method of assembling the same will be described with reference to FIGS. 5A, 5B, and 6A to 6C. It should be noted that in the following, component parts corresponding to those of the hammer 4 of the first embodiment are denoted by the same reference numerals, and detailed description thereof is omitted, but only different points from the hammer 4 will be described.

Figure 5A:
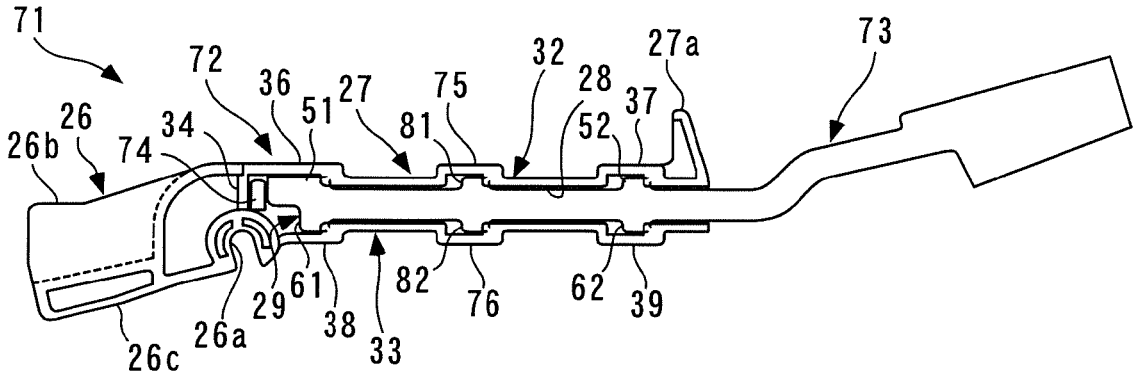
FIG. 5A is a side view of a hammer according to a second embodiment of the present invention.
Figure 5B:
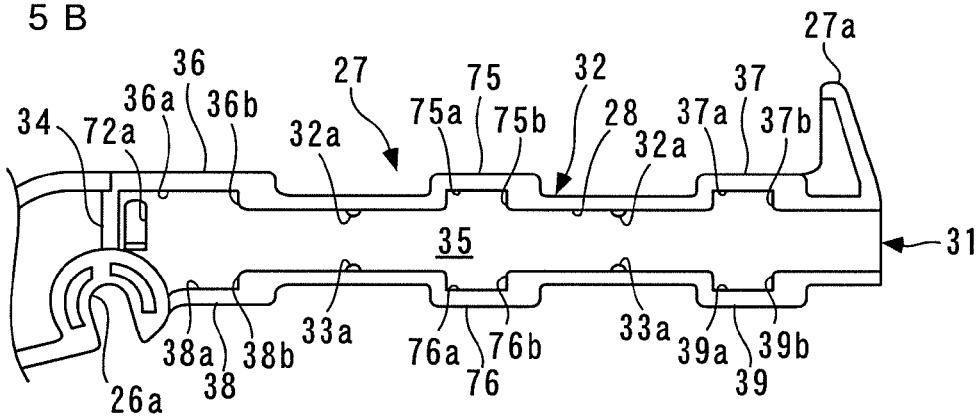
FIG. 5B is a side view showing a weight mounting portion of a hammer body and a mounting portion of a weight in a state separated from each other, on an enlarged scale.
Figure 5B:
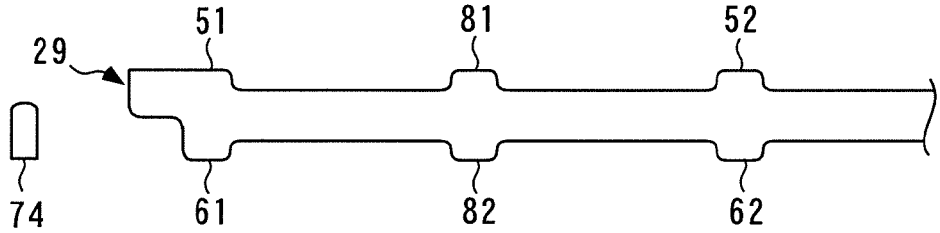

As shown in FIGS. 5A and 53, the hammer 71 comprises a hammer body 72 which is a resin molded article, a metal weight 73, and a weight retaining member 74 for preventing fall-off of the weight 73. On each of the upper and lower walls 32 and 33 of the weight mounting portion 27 of the hammer body 72, there are formed three protrusions larger in number than those of the weight mounting portion 27 of the hammer body 24 in the first embodiment by one. Specifically, the upper wall 32 has not only the front protrusion 36 and the rear protrusion 37, but also a central protrusion 75 formed between the two protrusions 36 and 37. Similarly, the lower wall 33 has not only the front protrusion 38 and the rear protrusion 39, but also a central protrusion 76 formed in a manner vertically symmetrical to the central protrusion 75.

The housing portion 35 of the weight mounting portion 27 has inwardly-opening recesses formed by the inner surfaces of the respective six protrusions 36 to 39, 75, and 76. Specifically, the upper portion of the housing portion 35 is formed with the front recess 36*a*, the rear recess 37*a*, and a central recess 75*a* corresponding, respectively, to the front protrusion 36, the rear protrusion 37, and the central protrusion 75 of the upper wall 32, while the lower portion of the housing portion 35 is formed with the front recess 38*a*, the rear recess 39*a*, and a central recess 76*a* corresponding, respectively, to the front protrusion 38, the rear protrusion 39, and the central protrusion 76 of the lower wall 33.

Differently from the hammer body 24 in the first embodiment, each of the front protrusions 36 and 38, the rear protrusions 37 and 39 and the central protrusions 75 and 76 of the upper wall 32 and the lower wall 33 has a rear end thereof formed with an engaging portion for preventing fall-off of the mounting portion 29 of the weight 73. Specifically, the rear ends of the front and rear protrusions 36 and 37 and the central protrusion 75 of the upper wall 32 have respective latching portions 36*b*, 37*b*, and 75*b* formed on an opening-side end of the housing portion 35, while the rear ends of the front and rear protrusions 38 and 39 and the central protrusion 76 of the lower wall 33 are formed with respective latching portions 38*b*, 39*b*, and 76*b*.

The left side wall 31 of the weight mounting portion 27 has a front end thereof formed with a mounting hole 72*a* to which the weight retaining member 74 is removably attached.

On the other hand, the mounting portion 29 of the weight 73 has a shape complementary to the opening 28 of the housing portion 35 of the weight mounting portion 27 of the hammer body 72. Specifically, the upper portion of the mounting portion 29 is formed with the front protrusion 51, the rear protrusion 52, and a central protrusion 81 corresponding, respectively, to the front recess 36*a*, the rear recess 37*a*, and the central recess 75*a* as the upper wall-side recesses, while the lower portion of the mounting portion 29 is formed with the front protrusion 61, the rear protrusion 62, and a central protrusion 82 corresponding, respectively, to the front recess 38*a*, the rear recess 39*a*, and the central recess 76*a* as the lower wall-side recesses. The protrusions 61, 62, and 82 are formed to be equal in size to each other, and the two protrusions 82 and 62 central and rear are formed in a manner vertically symmetrical to the upper central protrusion 81 and the upper rear protrusion 52. Further, the upper front protrusion 51 of the mounting portion 29 is formed to have a larger width in the front-rear direction and protrude further forward than the lower front protrusion 61.

The weight retaining member 74 is a resin molded article made of the same resin material as the hammer body 72. Further, the weight retaining member 74 is formed in a relatively small block shape, and has a protrusion (not shown) to be press-fitted in the mounting hole 72*a* of the left side wall 31 of the weight mounting portion 27.

Figure 6A:
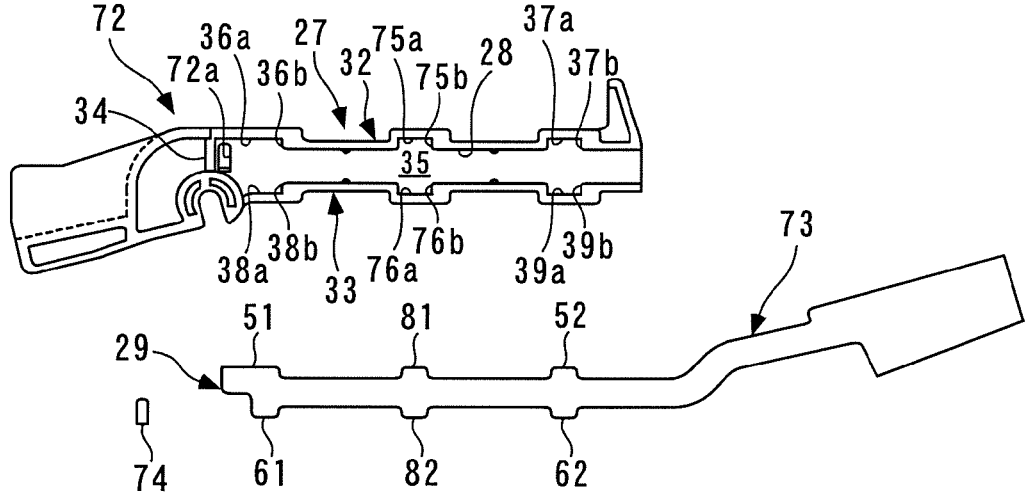
FIGS. 6A to 6C are views useful in explaining a sequence for assembling the hammer in FIG. 5.
Figure 6B:
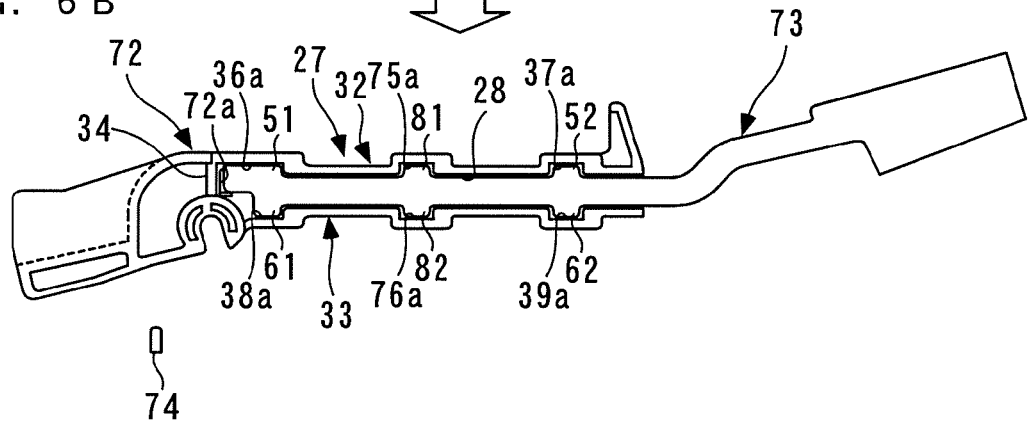
Figure 6C:
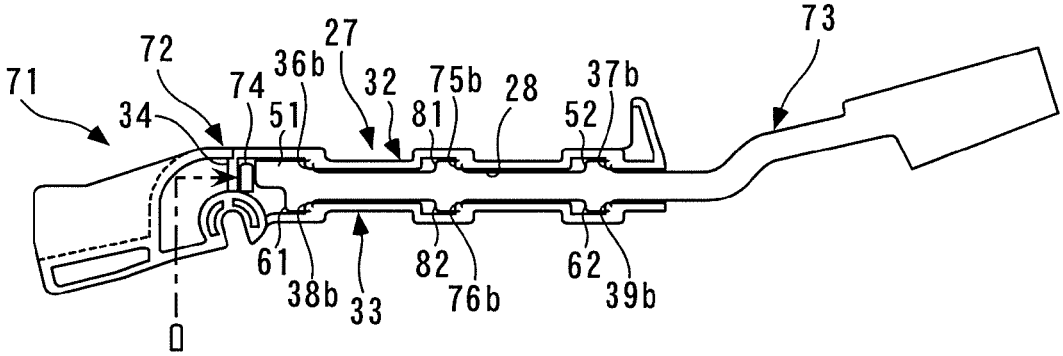

Next, the method of mounting the weight 73 to the hammer body 72 will be described with reference to FIGS. 6A to 6C. First, the hammer body 72, the weight 73, and the weight retaining member 74 are prepared as shown in FIG. 6A, and the mounting portion 29 of the weight 73 is fitted in the housing portion 35 (fit-in position) of the weight mounting portion 27 via the opening 28 of the hammer body 72 as shown in FIG. 6B, similarly to the first embodiment. In this case, the front end of the mounting portion 29 is brought to a location close to the front wall 34 of the weight mounting portion 27.

Then, one of the hammer body 72 and the weight 73 is fixed, and the other of the two is slid to thereby bring the front wall 34 of the weight mounting portion 27 and the front end of the mounting portion 29 away from each other, inversely to the case in the first embodiment. For example, in FIG. 6B, if the hammer body 72 is fixed, the weight 73 is slid rearward (rightward as viewed in FIG. 6B). As a consequence, the mounting hole 72*a* of the weight mounting portion 27 faces outside via the opening 28. Then, the weight retaining member 74 is inserted in between the front wall 34 of the weight mounting portion 27 and the front end of the mounting portion 29 and press-fitted in the mounting hole 72*a*. Thus, the mounting portion 29 of the weight 73 is held in a fixed position shifted rearward of the fit-in position as shown in FIG. 6C, and the assembly of the hammer 71 is completed.

In the hammer 71, each of the upper and lower front protrusions 51 and 61, the upper and lower rear protrusions 52 and 62, and the central protrusions 81 and 82 of the mounting portion 29 of the weight 73 has its rear end sandwiched between the left side wall 31 of the weight mounting portion 27 of the hammer body 72 and an associated one of the upper and lower latching portions 36*b*, 37*b*, 38*b*, 39*b*, 75*b*, and 76*b*. As a consequence, the mounting portion 29 is not only prevented from falling off from the opening 28, but also made immovable in the direction of thickness thereof. Further, since the weight retaining member 74 functions as a wedge, the mounting portion 29 positioned in the fixed position is held unslidable to the fit-in position as well as immovable in the direction of length.

As described above, according to the present embodiment, it is possible to obtain the hammer 71 with the weight 73 securely mounted to the hammer body 72 such that it does not wobble, similarly to the first embodiment. Further, although work for mounting the weight retaining member 74 is required during assembly of the hammer 71, and work for dismounting the weight retaining member 74 is required during disassembly of the hammer 71, it is possible to assemble and disassemble the hammer 71 relatively easily.

It should be noted that the present invention is by no means limited to the above-described embodiments, but it can be practiced in various forms. Although in the above-described embodiments, the hammer 4 and the hammer 71 are applied to an electronic piano, the present invention is also applicable to hammers for other electronic keyboard instruments.

Further, although in the above-described embodiments, during assembly of the hammer 4 (71), the mounting portion 29 of the weight 25 (73) is fitted in the housing portion 35 of the weight mounting portion 27 of the hammer body 24 (72) and then slid in the front-rear direction of the housing portion 35 to be held in a state in which it is prevented from falling off from the opening 28, this is not limitative, but it is also possible to configure a weight and a hammer body such that the mounting portion of the weight can be slid in a different direction from the front-rear direction, which is different from the left-right direction in which the mounting portion 29 is fitted in the housing portion 35. Further, the details of the construction of the hammers 4 and 71 described in the respective embodiments are given only by way of example, and various changes and modifications may be made without departing from the spirit and scope of the present invention.

What is claimed is:

1. A hammer for an electronic keyboard instrument, which pivotally moves in accordance with depression of a key to thereby impart touch weight to the key, comprising:

a hammer body that is formed by a resin molded article and having a weight mounting portion extending in a front-rear direction; and a weight that is formed of a material larger in specific gravity than said hammer body and has a mounting portion to be mounted to said weight mounting portion, said weight being removably mounted to said hammer body via said mounting portion, wherein said weight mounting portion of said hammer body comprises:

a housing portion that has an opening open on one side in a left-right direction and having a shape complementary to said mounting portion of said weight, and houses said mounting portion in a manner slidable between a fit-in position in which said mounting portion is fitted via the opening and a fixed position shifted from the fit-in position in a direction different from the left-right direction, a latching portion that is formed on a rim of the opening and latches said mounting portion in a state undetachable from the opening when said mounting portion is positioned in the fixed position, and a holding portion that holds said mounting portion in a state incapable of sliding to the fit-in position when said mounting portion is positioned in the fixed position.

2. The hammer according to claim 1, wherein said holding portion comprises a hook engaged with said mounting portion to inhibit said mounting portion from sliding to the fit-in position when said mounting portion is positioned in the fixed position, but allow said mounting portion to slide to the fit-in position when an external force not smaller than a predetermined magnitude acts on said mounting portion in a direction toward the fit-in position.

3. The hammer according to claim 2, wherein said holding portion further comprises an engaging protrusion protruding inward from an inner surface of said housing portion, for engagement with said mounting portion.

4. The hammer according to claim 1, wherein the inner surface of said housing portion is formed with a protrusion that is brought into pressure contact with said mounting portion to thereby suppress wobbling of said mounting portion.

* * * * *